US008342389B2

(12) United States Patent
Mills et al.

(10) Patent No.: US 8,342,389 B2
(45) Date of Patent: Jan. 1, 2013

(54) FILMS, PACKAGING AND METHODS FOR MAKING THEM

(75) Inventors: Peter Mills, Wigton (GB); Steven Maude, Wigton (GB)

(73) Assignee: Innovia Films, Ltd., Wigton, Cumbria (GB)

( * ) Notice: Subject to any disclaimer, the term of this patent is extended or adjusted under 35 U.S.C. 154(b) by 350 days.

(21) Appl. No.: 12/677,436

(22) PCT Filed: Sep. 3, 2008

(86) PCT No.: PCT/GB2008/050778

§ 371 (c)(1),
(2), (4) Date: May 19, 2010

(87) PCT Pub. No.: WO2009/034377

PCT Pub. Date: Mar. 19, 2009

(65) Prior Publication Data

US 2010/0221469 A1 Sep. 2, 2010

(30) Foreign Application Priority Data

Sep. 14, 2007 (GB) ..... 0717974.0

(51) Int. Cl.
*B65D 65/26* (2006.01)

(52) U.S. Cl. ..... 229/87.05

(58) Field of Classification Search ..... 229/87.05, 229/307, 309–316; 383/200, 201, 203–209; 428/43, 35.2, 35.5, 35.7
See application file for complete search history.

(56) References Cited

U.S. PATENT DOCUMENTS

| | | | | |
|---|---|---|---|---|
| 2,266,958 | A * | 12/1941 | Corbin | 428/43 |
| 2,687,978 | A * | 8/1954 | Vogt | 428/43 |
| 5,198,276 | A * | 3/1993 | Nakajima | 428/43 |
| 6,296,926 | B1 * | 10/2001 | Huebner | 428/172 |
| 6,635,334 | B1 * | 10/2003 | Jackson et al. | 428/136 |
| 6,685,084 | B2 * | 2/2004 | Timbrook et al. | 229/101.1 |
| 7,138,169 | B2 * | 11/2006 | Shiota et al. | 428/134 |
| 2004/0074799 | A1 | 4/2004 | Bell | |
| 2007/0104917 | A1 * | 5/2007 | Krug et al. | 428/43 |

FOREIGN PATENT DOCUMENTS

| | | | |
|---|---|---|---|
| DE | 197 36 730 | A1 | 2/1999 |
| GB | 488 743 | A | 7/1938 |
| WO | 01/02265 | A | 1/2001 |
| WO | 2006/066683 | A | 6/2006 |

OTHER PUBLICATIONS

International Preliminary Report on Patentability (Chapter I of the Patent Cooperation Treaty) and Written Opinion of the International Searching Authority for PCT/GB2008/050778, dated Mar. 25, 2010.

* cited by examiner

*Primary Examiner* — Jes F Pascua
(74) *Attorney, Agent, or Firm* — Ping Wang; Andrews Kurth, LLP

(57) ABSTRACT

The invention relates to a flexible polymeric film for enveloping a container comprising: a tear path; and a tear tab extending from the outer surface of the film; wherein the tear path comprises at least one fault line arranged to facilitate tearing of the film in one direction when the tear tab is pulled in a direction generally perpendicular to the container; wherein the at least one fault line comprises an embossed pattern being positioned to enhance the sound generated by the tearing of the at least one fault line.

19 Claims, 3 Drawing Sheets

FILMS, PACKAGING AND METHODS FOR MAKING THEM

FIELD

This invention concerns films and packages produced therefrom which include means for facilitating their opening and/or applying line(s) and/or patterns thereto, as well as methods for producing such films.

BACKGROUND

Flexible polymeric films are widely used as packaging materials for a vast range of goods.

Furthermore, a variety of synthetic polymers are used for producing such packaging materials, for example films made from synthetic polymers, such as (polyolefins [e.g. polyethylene and/or, polypropylene] polystyrene and/or polyesters) and/or natural polymers (such as cellulosic materials and/or biopolymers e.g. polylactic acid).

One particular packaging use for such films is as an overwrap for a variety of goods, for example for cigarette packets, video tapes, cookies etc., the films being sealed tightly over the goods. However, the very properties which confer desirable properties on the films as packaging materials, for example high strength and tear resistance, make such packages difficult to open because the films of which they are made are difficult to tear.

In order to facilitate the opening of such packages, so-called "tear tapes" have been provided which consist of a narrow strip of a polymeric film adhered to internal surface of the packaging film, a tab of the tear tape being left free on the outside of package to facilitate its opening. The package can then be opened by pulling the tear tape through the packaging film.

As an alternative to tear tapes, it is also known to use "tear strips" in a film. Tear strips differ to tear tapes in that a tear strip is integral to the film itself, rather than a separate film located adjacent the packaging film. A tear strip is typically defined by two parallel lines of weakness in a film, so that when the tear strip is pulled in a direction generally away from the rest of the packaging the lines of weakness break in a controlled manner and the packaging can be opened.

US2005087282 describes a non-invasive tear mechanism for a flexible packaging, the non-invasive tear mechanism comprises a horn side wall and an anvil side wall joined to the horn side wall. A plurality of junctions are formed in flexible packaging and form a line of weakness in the flexible packaging. The plurality of junctions that form the line of weakness allows the flexible packaging to be manually opened, and the junctions are non-invasive in that the flexible packaging is not cut or scored when the non-invasive tear mechanism is formed.

GB 458375 discloses an arrangement where a wrapping blank is used which has a box pleat provided along the whole length of the blank. The wrapper is folded in to a U-shape about the article to be enclosed and the side folds of the wrapper are then formed and secured. The end of the package is closed by end folds and end flaps. The outer end fold has slits formed adjacent to the pleat and the package can be opened by initiating tearing at the slits so that the tear propagates along each side of the pleat.

U.S. Pat. No. 6,120,629 relates to ultrasonically processing a web to produce discrete treated regions, comprising elongated bands, across the width of the web, e.g., for use as tear lines in a continuous tape web.

GB-A-2311752 discloses a semi-matt plastics film having a regular embossed pattern which, when rubbed against itself, emits a distinctive noise.

US-A-2007/0104917 discloses a multiple layer material construction with a break line formed by a line-shaped, successive arrangement of blind holes separated by webs, there being abrupt jumps in material thickness along the break line such that a noise is generated when the break line tears.

EP-A-0343857 discloses and outer wrapper for a container which opens along an oblique parting line, the wrapper including a tear tape having a pattern such that each portion of the parting line has an aligned tear tape portion.

EP-A-1666376 discloses a tear tape and a weakening line next to the tear tape, the longitudinal axis of the weakening line being substantially perpendicular to the tear tape.

One problem identified in the film packaging market is how to make packaging more distinctive and preferably easier and more enjoyable to use. There are several commonly used film treatment techniques which can advantageously improve the tactile properties of a film, or part of a film. There are also known methods of treating regions of a film to change the light reflecting/absorbing properties, both externally and internally of the film to enhance the films aesthetic properties.

The known techniques for modifying the distinctive properties of a film are, in general, limited to its tactile and aesthetic features. However, in a film having a tear tape it has been found that it is advantageously possible to deliberately use the mechanical energy from the tearing process to create acoustic energy US 2007/104917 is directed to packaging comprising a multiple-layer material construction with a break line which is formed by a line-shaped, successive arrangement of blind holes separated by webs and in which the multiple-layer material construction comprises at least one layer which absorbs laser radiation and a layer which reflects this laser radiation. A radiation-absorbing layer forms the surface layer of the packaging, and the blind holes of the surface layer extend into the packaging until the reflecting layer, and the web widths are substantially constant over the depths of the blind holes so that there are abrupt jumps in material thickness along the break line, and a clearly audible noise is generated when these jumps in material thickness are overcome when the break line tears.

BRIEF DESCRIPTION OF THE DRAWINGS

Embodiments of a film and according to the present invention will now be described, by way of example only, with reference to the accompanying drawings and examples.

DETAILED DESCRIPTION

Figure 1:
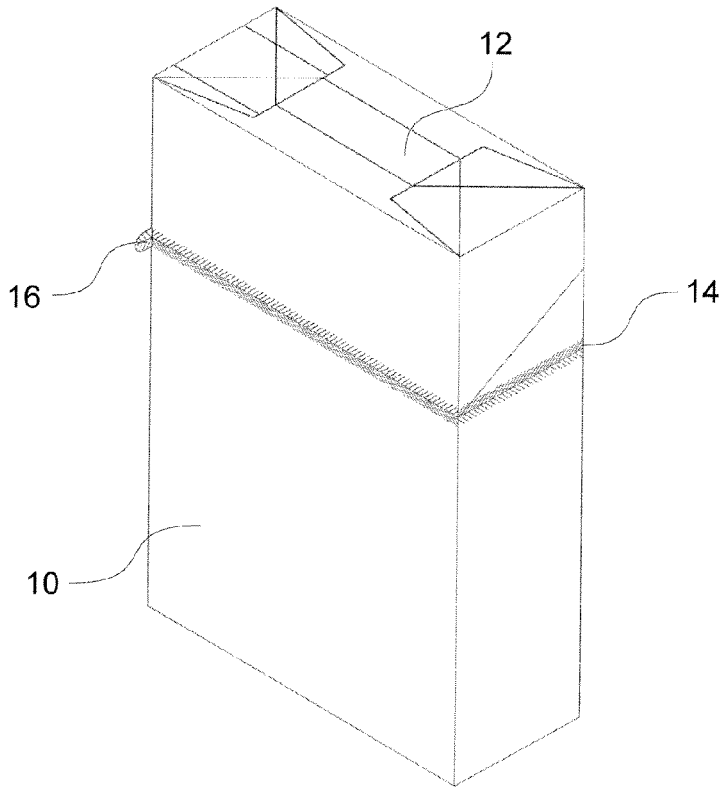
FIG. 1 is an illustration (not to scale) of a film according to one embodiment of the present invention enclosing a container.

It is an object of the invention to provide a polymer film having enhanced functionality by treating a region of the film in such a way as to increase the acoustic energy released from the film during tearing and advantageously produces a deliberate and distinctive audible sound.

According to the present invention there is provided a flexible polymeric film for enveloping a container comprising: a tear path; and a tear tab extending from the outer surface of the film;

wherein the tear path comprises at least one fault line arranged to facilitate tearing of the film in one direction when the tear tab is pulled in a direction generally perpendicular to the container; wherein said at least one fault line comprises an embossed pattern being convergent with the tear path and/or the at least one fault line to enhance the sound generated by the tearing of the at least one fault line.

Normally the embossed pattern will be convergent with both the tear path and the at least one fault line.

Preferably, the embossed pattern is orientated generally in the direction of the tear path, which is for example to say that resolved directional vectors of the embossed pattern, or part of it, will have a component in the direction of the tear path as well as a component perpendicular thereto. In the event that the embossed pattern is a series of straight and parallel lines, those lines will be seen to point in the direction of the tear path whilst also being convergent with it, in the manner of a chevron. However, as will be apparent hereinafter, the embossed pattern need not be a series of straight and parallel lines and many other many other embodiments are contemplated within the scope of this invention.

By "convergent" is not necessarily meant that the embossed pattern actually meets the tear path or the at least one fault line. The embossed pattern will be convergent with the tear path even if it stops short of actually meeting the tear path or fault line, but would do so if extended further in the manner of the pattern.

According to one embodiment of the present invention the tear tab comprises a first end of a tear tape located on the inner surface of the film and extending along the length of the tear path adjacent to the at least one fault line. Using the tear tab, the tear tape can pulled through the film in the region of the fault line, the tearing of the film being delimited by the embossed pattern.

Alternatively, the tear tab may comprise a first end of a tear strip, said tear strip being defined by a first fault line and a second fault line. A tear strip is integral to the film so in this arrangement there is no need for a separate tear tape.

Preferably, the fault line and/or the embossed pattern comprises one or more regions of weakness or thinning and/or one or more perforations.

Advantageously, the embossed pattern is mirrored along the fault line or the tear path and preferably comprises a repetitive pattern along the length of the tear path.

The embossed pattern may comprise any correctly orientated pattern, but preferably the pattern is a herringbone pattern.

The tear path preferably extends the entire length of the film, so that one the tear tape has been completely pulled through the film the top section of the film is separated from the bottom section.

Preferably, the fault line and/or the embossed pattern are created using ultrasonic vibration, although any suitable know method could also be used.

Ultrasonic vibration may be applied to the film region in any suitable manner and at any suitable power. Such vibration may for example be delivered to the film through an applicator head, known as a sonotrode, or horn, vibrating at ultrasonic frequency and pressed against the surface of the film.

One suitable ultrasonic treatment apparatus is available from Hellmann Ultrasonics Inc of 620 Estes Ave, Schaumburg Ill. 60193, USA. However, many other suitable apparatus may also be used.

The films used in accordance with the present invention can be of a variety of thicknesses according to the application requirements. For example they can be from about 10 to about 240 μm thick and preferably from about 50 to about 90 μm thick. The treated region of the film is preferably of a narrower gauge than the rest of the film—for example the treated region of the film may have a gauge of at least about 1%, preferably at least about 2%, more preferably at least about 5% and most preferably at least about 10% lower than the rest of the film.

The films used in the present invention, prior to deposition of any coating and/or skin or lamination layer may comprise any suitable polymeric filmic substrate, such as films made from biopolymers such as any of those described herein [preferably polylactic, polygalactic and/or cellulosic films (e.g. microbal and/or regenerated cellulose film)]; thermoplastic films; polymeric films (for example films comprising: polyolefins [e.g. polypropylene and/or polyethylene] polyurethanes, polyvinylhalides [e.g. PVC], polyesters [e.g. polyethylene terephthalate-PET], polyamides [e.g. nylons] and/or non-hydrocarbon polymers); and/or multilayer and/or composite sheets formed by any suitable combinations and/or mixtures of thereof. Suitable filmic substrates therefore include polyolefinic films, but also polyester films, polyurethane films, cellulosic and PLA films.

The film may therefore comprise a cellulosic material, polymeric material and/or thermoplastic polymer, and may conveniently comprise polymers of low surface energy. More preferably the sheet comprises a homopolymer, a crystalline polymer and/or a polymer of randomly oriented amorphous non-crystalline polymer chains. Most preferably the sheet comprises: polyolefins [e.g. polypropylene and/or polyethylene] polyurethanes, polyvinylhalides [e.g. polyvinyl chloride (PVC)], polyesters [e.g. polyethylene terephthalate-PET], polyamides [e.g. nylons] and/or non-hydrocarbon polymers).

Conveniently the polyolefin films to be used with the present invention may comprise one or more polyolefins [e.g. polypropylene homopolymer, polyethylene homopolymer (e.g. linear low-density polyethylene-LLDPE) and/or polypropylene/polyethylene copolymer(s); optionally in one or more layers]. The constituent polymers and/or layers in a film of the present invention may be oriented, blown, shrunk, stretched, cast, extruded, co-extruded and/or comprise any suitable mixtures and/or combinations thereof. Preferred films comprise a major proportion of polypropylene and/or an olefin block copolymer containing up to about 15% w/w of the copolymer of at least one copolymerisable olefin (such as ethylene). More preferred films comprise polypropylene homopolymer, most preferably isotactic polypropylene homopolymer.

Films may optionally be cross-linked by any suitable means such as electron beam (EB) or UV cross-linking, if necessary by use of suitable additives in the film.

The definition of polyolefin, as intended herein, is a polymer assembled from a significant percentage, preferably ≧50% by weight of one or more olefinic monomers.

The definition of copolymer herein, is a polymer assembled from two or more monomers. Such polymers may include, but are not limited to, polyethylene homopolymers, ethylene-α-olefin copolymers, polypropylene-α-olefin copolymers, polypropylene homopolymers, ethylene-vinyl acetate copolymers, ethylene-methacrylic acid copolymers and their salts, ethylene-styrene polymers and/or blends of such polymers. The polymers may be produced by any suitable means, for example one or more of free radical polymerisation (e.g. peroxy compounds), metallocene catalysis and/or coordination catalysis (e.g. Ziegler and/or Nana catalysts and/or any variations thereof).

Polymeric resins used to produce the films of the present invention are generally commercially available in pellet form and may be melt blended or mechanically mixed by well-know methods known in the art, using commercially available equipment including tumblers, mixers and/or blenders. The resins may have other additional resins blended therewith along with well-know additives such as processing aids and/or colorants. Methods for producing polyolefin films are well-know and include the techniques of casting films as thin sheets through narrow slit dies, and blown-film techniques wherein an extruded tube of molten polymer is inflated to the desired bubble diameter and/or film thickness.

For example to produce a polymeric film the resins and additives may be introduced into an extruder where the resins are melt plastified by heating and then transferred to an extrusion die for formation into a film tube. Extrusion and die temperatures will generally depend upon the particular resin being processed and suitable temperature ranges are generally known in the art or provided in technical bulletins made available by resin manufacturers. Processing temperatures may vary depending upon process parameters chosen.

Thus, the polymeric film can be made by any process known in the art, including, but not limited to, cast sheet, cast film, or blown film. This invention may be particularly applicable to films comprising cavitated or non-cavitated polypropylene films, with a block copolymer polypropylene/polyethylene core and skin layers with a thickness substantially below that of the core layer and formed for example from random co-polymers of ethylene and propylene or random terpolymers of propylene, ethylene and butylene. The film may comprise a biaxially orientated polypropylene (BOPP) film, which may be prepared as balanced films using substantially equal machine direction and transverse direction stretch ratios, or can be unbalanced, where the film is significantly more orientated in one direction (MD or TD). Sequential stretching can be used, in which heated rollers effect stretching of the film in the machine direction and a stenter oven is thereafter used to effect stretching in the transverse direction. Alternatively, simultaneous stretching, for example, using the so-called bubble process, or simultaneous draw stenter stretching may be used.

Polymeric resins used to produce the films of the present invention are generally commercially available in pellet form and may be melt blended or mechanically mixed by well-know methods known in the art, using commercially available equipment including tumblers, mixers and/or blenders. The resins may have other additional resins blended therewith along with well-know additives such as processing aids and/or colorants. Methods for producing polyolefin films are well-know and include the techniques of casting films as thin sheets through narrow slit dies, and blown-film techniques wherein an extruded tube of molten polymer is inflated to the desired bubble diameter and/or film thickness.

For example to produce a polymeric film the resins and additives may be introduced into an extruder where the resins are melt plastified by heating and then transferred to an extrusion die for formation into a film tube. Extrusion and die temperatures will generally depend upon the particular resin being processed and suitable temperature ranges are generally known in the art or provided in technical bulletins made available by resin manufacturers. Processing temperatures may vary depending upon process parameters chosen.

A film of the present invention may be oriented by stretching at a temperature above the glass transition temperature (Tg) of its constituent polymer(s). The resultant oriented film may exhibit greatly improved tensile and stiffness properties.

Conveniently a film comprising a propylene homopolymer is oriented at a temperature within a range of from about 145° C. to 165° C. Orientation may be along one axis if the film is stretched in only one direction, or may be biaxial if the film is stretched in each of two mutually perpendicular directions in the plane of the film. A biaxial oriented film may be balanced or unbalanced, where an unbalanced film has a higher degree of orientation in a preferred direction, usually the transverse direction. Conventionally the longitudinal direction (LD) is the direction in which the film passes through the machine (also known as the machine direction or MD) and the transverse direction (TD) is perpendicular to MD. Preferred films are oriented in both MD and TD. Orientation of the film may be achieved by any suitable technique. For example in the bubble process the polypropylene film is extruded in the form of a composite tube which is subsequently quenched, reheated, and then expanded by internal gas pressure to orient in the TD, and withdrawn, at a rate greater than that at which it is extruded, to stretch and orient it in the MD. Alternatively a flat film may be oriented by simultaneous or sequential stretching in each of two mutually perpendicular directions by means of a stenter, or by a combination of draw rolls and a stenter. A preferred oriented film comprises biaxially oriented polypropylene (known herein as BOPP), more preferably the BOPP film described in EP 0202812.

The degree to which the film substrate is stretched depends to some extent on the ultimate use for which the film is intended, but for a polypropylene film satisfactory tensile and other properties are generally developed when the film is stretched to between three and ten, preferably, seven or eight, times its original dimensions in each of TD and MD.

After stretching, the polymeric film substrate is normally heat-set, while restrained against shrinkage or even maintained at constant dimensions, at a temperature above the Tg of the polymer and below its melting point. The optimum heat-setting temperature can readily be established by simple experimentation. Conveniently a polypropylene film is heat-set at temperatures in the range from about 100° C. to about 160° C. Heat-setting may be affected by conventional techniques for example by means one or more of the following: a stenter system; one or more heated rollers (e.g. as described in GB 1124886) and/or a constrained heat treatment (e.g. as described in EP 023776).

The film may comprise a major proportion of polypropylene such as isotactic polypropylene homopolymer, but also may comprise coextruded multilayer films where the polymer of at least one layer is isotactic polypropylene homopolymer, and the polymer of one or both outer layers is a surface layer polymer having different properties to the isotactic polypropylene homopolymer.

The sheet of the present invention may consist of only one layer, or the sheet may be multi-layered i.e. comprise a plurality of layers. The layers can be combined by lamination or co-extrusion. Preferably the sheet comprises at least three layers where at least one layer(s) are sandwiched between other layers such that none of such sandwiched layer(s) form either surface of the sheet. The treated region of the film may be located in just one, in more than one, or in all such layers.

Thus, for example a film of the invention may comprise a three layer film where the polymer of a central or core layer comprises one polymeric material. The core layer may have a thickness of about 90 to about 98% of the total thickness of the film. The remainder of such a three layer film may comprise two outer layers of another polymeric material, with each outer layer having substantially identical thickness, Preferably, at least the core layer is treated. In a coextruded film it may be convenient to treat all layers of the coextrudate. In the case of a laminated film it may be desirable to treat the film prior to lamination, in which case only part of the laminated structure will have the treated region thereon—or it may in some cases be desirable to treat the film after lamination, in which case all of the laminated structure will have the treated region thereon. Likewise with coatings—the treatment of the film to provide a treated region of substantially different opacity to the remainder of the film can take place before or after any such coating.

Multiple-layer films of the invention may be prepared in a range of thicknesses governed primarily by the ultimate application for which a particular film is to be employed. For general use films, having a mean thickness from about 2.5 μm to about 150 μm, preferably from about 4 μm to about 100 μm are suitable. For certain applications, such as packaging, preferred films have a mean thickness of from about 10 μm to 50 μm, most preferably from about 8 um to about 40 μm.

If desired, before coating a sheet of the present invention (e.g. with a gas barrier coating of the present invention and/or any other coating and/or layer) may be subjected to a chemical or physical surface-modifying treatment to ensure that the coating and/or layer will better adhere to the sheet thereby reducing the possibility of the coating peeling or being stripped from the sheet. Known prior art techniques for surface pre-treatment prior to coating comprise, for example: film chlorination, i.e., exposure of the film to gaseous chlorine; treatment with oxidising agents such as chromic acid, hot air or steam treatment; flame treatment and the like. A preferred treatment, because of its simplicity and effectiveness, is the so-called electronic treatment in which the sheet is passed between a pair of spaced electrodes to expose the sheet surface to a high voltage electrical stress accompanied by corona discharge.

Optionally if even adhesion of the coating is desired an intermediate continuous coating of a primer medium and/or anchor coating can be applied to a sheet surface treated by any of the methods described herein. Primer materials may comprise titanates and poly (ethylene imine) and may be applied as conventional solution coatings [such as poly (ethylene imine) applied as either an aqueous or organic solvent solution, e.g. in ethanol comprising about 0.5 wt % of the imine]. Another primer medium comprises the interpolymerised condensation acrylic resins prepared in the presence of a $C_{1-6}$alkanol as described in either: GB 1134876 (condensing amonoaldehyde with an interpolymer of acrylamide or methacrylamide with at least one other unsaturated monomer); or in GB 1174328 (condensing amonoaldehyde with acrylamide or methacrylamide, and subsequently interpolymerising the condensation product with at least one other unsaturated monomer).

The film may comprise one or more additive materials. Additives may comprise: dyes; pigments, colorants; metallised and/or pseudo metallised coatings (e.g. aluminium); lubricants, anti-oxidants, surface-active agents, stiffening aids, gloss-improvers, prodegradants, UV attenuating materials (e.g. UV light stabilisers); sealability additives; tackifiers, anti-blocking agents, additives to improve ink adhesion and/or printability, cross-linking agents (such as melamine formaldehyde resin); adhesive layer (e.g. a pressure sensitive adhesive); and/or an adhesive release layer (e.g. for use as the backing material in the peel plate method for making labels).

Further additives comprise those to reduce coefficient of friction (COF) such as a terpolymer described in U.S. Pat. No. 3,753,769 which comprises from about 2% to about 15% w/w of acrylic or methacrylic acid, from about 10% to about 80% w/w of methyl or ethyl acrylate, and from about 10% to about 80% w/w of methyl methacrylate, together with colloidal silica and carnauba wax. Certain types of additive (e.g. fluorescers, photochromics and the like) may provide and enhanced visual effect to the film in the region of the embossed pattern.

Still further additives comprise slip aids such as hot slip aids or cold slip aids which improve the ability of a film to satisfactorily slide across surfaces at about room temperature for example micro-crystalline wax. Preferably the wax is present in the coating in an amount from about 0.5% to about 5.0% w/w, more preferably from about 1.5% to about 2.5% w/w. The wax particles may have an average size conveniently from about 0.1 μm to 0.6 μm, more conveniently from about 0.12 μm to about 0.30 μm.

Yet further additives comprise conventional inert particulate additives, preferably having an average particle size of from about 0.2 μm to about 4.5 μm, more preferably from about 0.7 μm to about 3.0 μm. Decreasing the particle size improves the gloss of the film. The amount of additive, preferably spherical, incorporated into the or each layer is desirably in excess of about 0.05%, preferably from about 0.1% to about 0.5%, for example, about 0.15%, by weight. Suitable inert particulate additives may comprise an inorganic or an organic additive, or a mixture of two or more such additives.

Suitable particulate inorganic additives include inorganic fillers such as talc, and particularly metal or metalloid oxides, such as alumina and silica. Solid or hollow, glass or ceramic micro-beads or micro-spheres may also be employed. A suitable organic additive comprises particles, preferably spherical, of an acrylic and/or methacrylic resin comprising a polymer or copolymer of acrylic acid and/or methacrylic acid. Such resins may be cross-linked, for example by the inclusion therein of a cross-linking agent, such as a methylated melamineformaldehyde resin. Promotion of cross-linking may be assisted by the provision of appropriate functional groupings, such as hydroxy, carboxy and amido groupings, in the acrylic and/or methacrylic polymer.

Yet still further additives comprise fumed silica for the purpose of further reducing the tack of a coating at room temperature. The fumed silica is composed of particles which are agglomerations of smaller particles and which have an average particle size of, for example, from about 2 μm to about 9 μm, preferably from about 3 μm to about 5 μm, and is present in a coating in an amount, for example, from about 0.1% to about 2.0% by weight, preferably about 0.2% to about 0.4% by weight.

Some or all of the desired additives listed above may be added together as a composition to coat the sheet of the present invention and/or form a new layer which may itself be coated (i.e. form one of the inner layers of a final multilayered sheet) and/or may form the outer or surface layer of the sheet. Alternatively some or all of the preceding additives may be added separately and/or incorporated directly into the bulk of the sheet optionally during and/or prior to the sheet formation (e.g. incorporated as part of the original polymer composition by any suitable means for example compounding, blending and/or injection) and thus may or may not form layers or coatings as such. These conventional other coatings and/or layers may thus be provided on top of or underneath the gas barrier coatings of the present invention and may be in direct contact thereto or be separated by one or more other intermediate layers and/or coats.

Such additives may be added to the polymer resin before the film is made, or may be applied to the made film as a coating or other layer. If the additive is added to the resin, the mixing of the additives into the resin is done by mixing it into molten polymer by commonly used techniques such as roll-milling, mixing in a Banbury type mixer, or mixing in an extruder barrel and the like. The mixing time can be shortened by mixing the additives with unheated polymer particles so as to achieve substantially even distribution of the agent in the mass of polymer, thereby reducing the amount of time needed for intensive mixing at molten temperature. The most preferred method is to compound the additives with resin in a twin-screw extruder to form concentrates which are then blended with the resins of the film structure immediately prior to extrusion.

Formation of a film of the invention (optionally oriented and optionally heat-set as described herein) which comprises one or more additional layers and/or coatings is conveniently effected by any of the laminating or coating techniques well known to those skilled in the art.

For example a layer or coating can be applied to another base layer by a coextrusion technique in which the polymeric components of each of the layers are coextruded into intimate contact while each is still molten. Preferably, the coextrusion is effected from a multi-channel annular die such that the molten polymeric components constituting the respective individual layers of the multi-layer film merge at their boundaries within the die to form a single composite structure which is then extruded from a common die orifice in the form of a tubular extrudate.

A film of the invention may also be coated with one or more of the additives described herein using conventional coating techniques from a solution or dispersion of the additive in a suitable solvent or dispersant. An aqueous latex, (for example prepared by polymerising polymer precursors of a polymeric additive) in an aqueous emulsion in the presence of an appropriate emulsifying agent is a preferred medium from which a polymeric additive or coating may be applied.

Coatings and/or layers may be applied to either or both surfaces of the sheet. The each coating and/or layer may be applied sequentially, simultaneously and/or subsequently to any or all other coatings and/or layers. If a gas-barrier coating of the present invention is applied to only one side of the sheet (which is preferred) other coatings and/or layers may be applied either to the same side of the sheet and/or on the reverse (other) side of the sheet.

A coating composition may be applied to the treated surface of sheet (such as the polymer film) in any suitable manner such as by gravure printing, roll coating, rod coating, dipping, spraying and/or using a coating bar. Solvents, diluents and adjuvants may also be used in these processes as desired. The excess liquid (e.g. aqueous solution) can be removed by any suitable means such as squeeze rolls, doctor knives and/or air knives. The coating composition will ordinarily be applied in such an amount that there will be deposited following drying, a smooth, evenly distributed layer having a thickness of from about 0.02 to about 10 μm, preferably from about 1 to about 5 μm. In general, the thickness of the applied coating is such that it is sufficient to impart the desired characteristics to the substrate sheet. Once applied to the sheet a coating may be subsequently dried by hot air, radiant heat or by any other suitable means to provide a sheet of the present invention with the properties desired (such as an optionally clear; optionally substantially water insoluble; highly oxygen impermeable coated film useful, for example in the fields of authentication, packaging, labelling and/or graphic art).

It would also be possible to use combinations of more than one of the above methods of applying additives and/or components thereof to a film. For example one or more additives may be incorporated into the resin prior to making the film and the one or more other additives may be coated onto the film surface.

Embodiments of a film and according to the present invention will now be described, by way of example only, with reference to the accompanying drawings and examples.

The present invention relies on creating weakened regions in a film. Suitable equipment for producing the weakened regions in the film comprise a horn and an anvil for applying pressure to two surfaces of the film, where the horn is capable of oscillating at ultrasonic frequencies. An exemplary machine with the desired characteristics is the Herrrmann Ultraschalltechnik, which has a horn capable of oscillating at 35 kHz. Alternatively, the film can be treated by laser deformation or ablation to create weaknesses and/or holes in the film as appropriate to create the desired pattern.

The weakened regions can also be created using any other known film treatment method, for example laser etching, heat treatment or pressing.

FIG. 1 is an illustrative example of the film 10 according to a first embodiment of the present invention being used as a protective enclosure for a container 12, for example for cigarette packets, video tapes, cookies etc. A tear path 14 is provided in the film 10 to facilitate the removal of the protective film 10 from the container 12. The tear path 14 is arranged to wrap around the entire circumference of the container 12. The example also shows a tear tab 16 formed from one end of a tear tape 18 which runs along the length of the tear path 14, positioned between the film 10 and the container 12. The tear tape 18 is typically made from a polymeric film and can be held in position using any know means.

Figure 2:
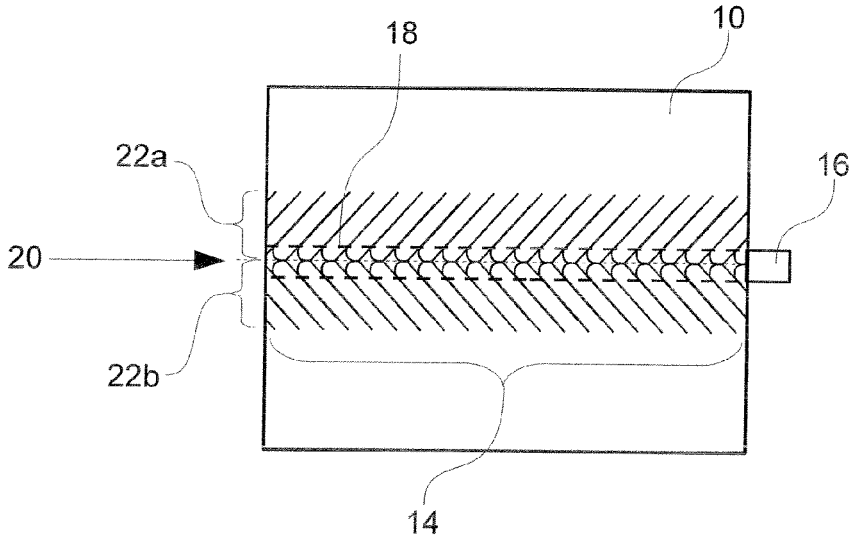
FIG. 2 is a magnified illustration of the tear path of a film of FIG. 1.

FIG. 2 is a magnified view of a section of the tear path 14 according to the first embodiment of the present invention. The tear path 14 comprises a region of weakness illustrated as a fault line 20, around which the film 10 is designed to tear or "burst" in a controlled manner when the tear tape 18 is pulled through the film 10 by pulling the tear tab 16 away from, and in a direction generally perpendicular to, the container 12. The fault line 20 can be made by either thinning the film 10 along the line 14 to create regions of weakness, or alternatively perforations can be made along the line 14 depending on the sealing requirements of the film enclosure.

The tear path 14 also includes an embossed pattern 22*a*; 22*b* in the region of the fault line 20. Although the term "embossed" is used throughout the description to describe the pattern, this is not intended to limit the scope of how the pattern can be created, and the word "embossed" is to be construed as including "de-bossed", "ablated" or "profiled". This embossed pattern 22*a*; 22*b* is designed to enhance the noise created when the tear tape 18 is pulled through the film 10. The embossed pattern 22*a*; 22*b*, illustrated in FIG. 2, consists of a series of parallel lines arranged in a direction along the tearing direction of the fault line 20. This type of pattern is commonly referred to as a herringbone pattern. By orientating the embossed pattern 22*a*; 22*b* in the same direction as the tear direction it has been advantageously found that not only is the tearing of the film easier to control, but also the noise level during tearing is enhanced. It has also been found advantageous to mirror the embossed pattern 22*a*; 22*b* on both sides of the fault line 20 because more of the mechanical energy supplied by the tearing, or "bursting" of the film 10 is released as acoustic energy, thereby making a louder and more audible sound.

The fault line 20 itself does not have to be embossed or perforated, but it is shown in the figures as a dotted line to represent the approximate path of the tear. In practice the tear line 20 is unlikely to be straight and is delimited by the embossed pattern 20*a*, 20*b*.

Figure 3:
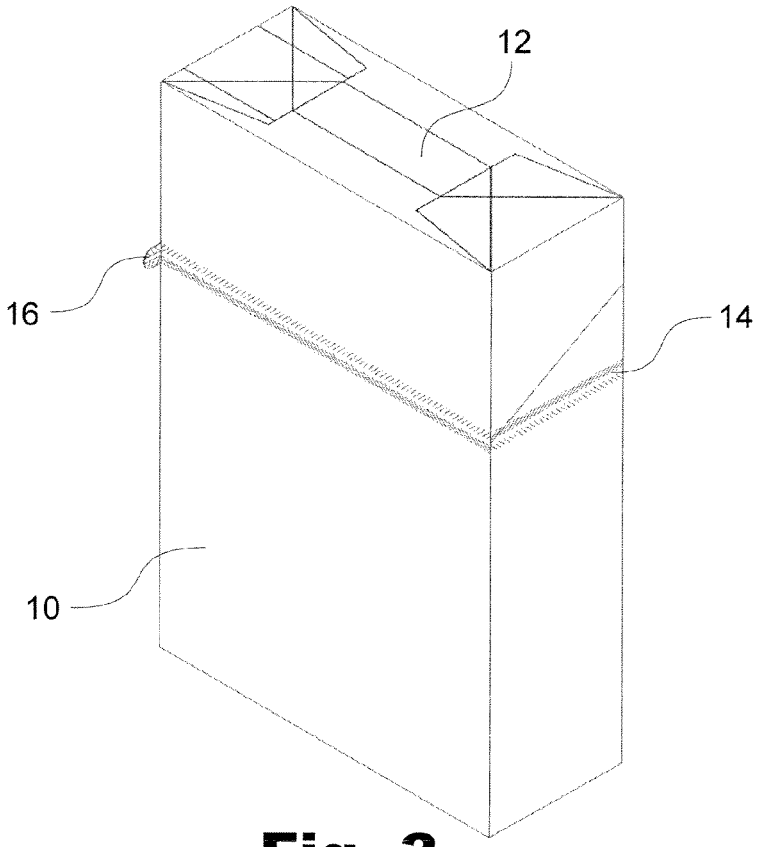
FIG. 3 is an illustration (not to scale) of a film according to a second embodiment of the present invention enclosing a container.
Figure 4:
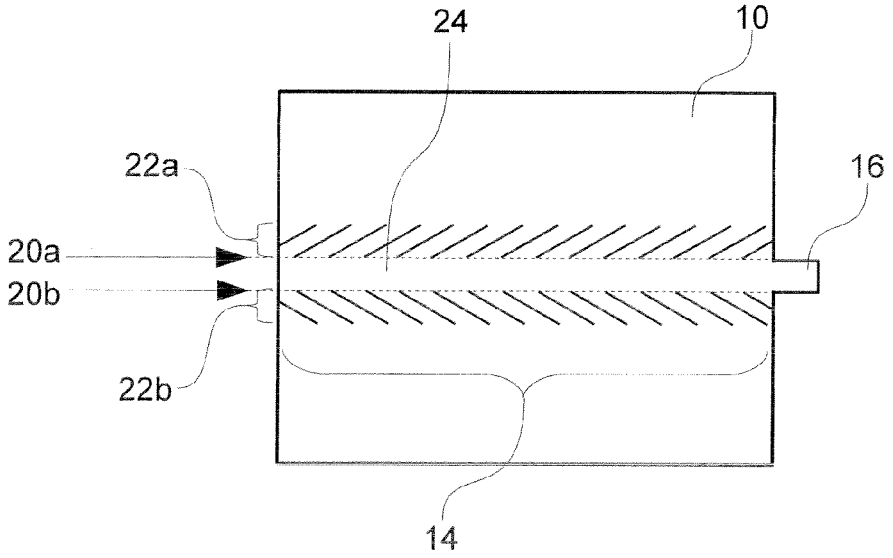
FIG. 4 is a magnified illustration of the tear path of a film of FIG. 3.

FIG. 3 illustrates a second embodiment of the present invention, wherein the tear tape 18 is replaced by a tear strip 24 which is integral to the film 10. As can be seen in more detail in FIG. 4, the tear line 14 comprises a tear strip 24 defined by two fault lines 20*a*, 20*b* arranged generally parallel to one another and typically spaced between 0.5 mm and 10 mm apart and more preferably between about 1 mm and 5 mm apart. Each fault line 20*a*, 20*b* is defined by a respective embossed pattern 22*a*, 22*b* which may comprise pattern only on the outer edge of the tear strip (as shown), or alternatively the pattern may be mirrored along each fault line 22*a*, 22*b* in a similar arrangement to that illustrated in any one of FIGS. 5*a* to 5*i* as further described below.

In this embodiment the tear tab 16 is formed from a section of the film 10 and located between the first fault line 20*a* and the second fault line 20*b*, thereby forming one end of the tear strip 24. When the tear tab 16 is pulled away from the container 12 the film tears generally along the path of both the first fault line 20*a* and the second fault line 20*b* so that the tear strip 24 is torn away from the rest of the film 10. The embossed pattern 22*a*, 22*b* both delimits the top and bottom edge of the tear strip 24 and also produces an audible sound by effectively making the tearing motion a series of "bursts" as the film breaks, rather than a continuous tear if the thickness of the tear region was linear. It will be appreciated that having two tear lines rather than one advantageously increases the amplitude of the audible sound thereby enhancing the desirable effect.

Figure 5A:
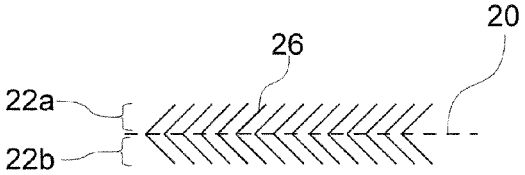
FIGS. 5*a* to 5*i* are illustrative examples of alternative embossed patterns for the tear path of the present invention.
Figure 5B:
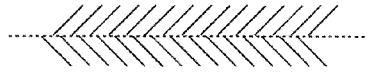
Figure 5C:
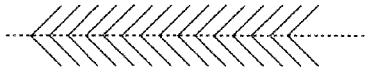
Figure 5D:
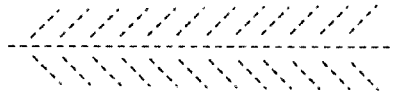
Figure 5E:
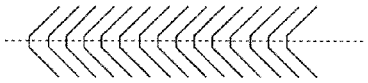
Figure 5F:
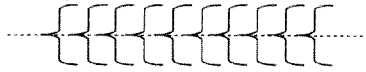
Figure 5G:
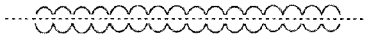
Figure 5H:
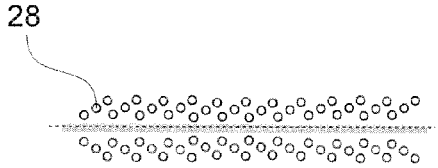
Figure 5I:
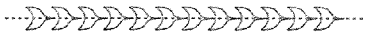

FIGS. 5*a* to 5*i* show examples of alternative embossed patterns according to the present invention. Each example comprises a repetitive series of either embossed lines 26, perforations 28, or a combination of embossed lines 26 and perforations 28. The embossed lines 26 and/or perforations 28 may be arranged in any shape having a directional pattern, for example FIG. 5*i* shows a particularly advantageous pattern called a "sharks tooth" pattern. It has been found that the audible sound released by the tearing of the film 10 is increased if a combination of film thinning and perforations 28 are used along the fault line 20, because the mechanical energy is released in bursts rather than a continual motion.

The illustrative examples of FIGS. 5*a* to 5*i* are arranged according to the first embodiment of the present invention, i.e. a single fault line 20. However, it will be clear to one skilled in the art that these patterns can be arranged to create more than one fault line 20 in the film 10, thereby creating one or more tear strips 24 as illustrated, and with reference to, FIGS. 3 and 4.

The invention claimed is:

1. A flexible thermoplastic polymeric film for enveloping a container comprising:

a tear path; and a tear tab extending from the outer surface of the film;

wherein the tear path comprises at least one fault line arranged to facilitate tearing of the film in one direction when the tear tab is pulled in a direction generally perpendicular to the container;

wherein said at least one fault line comprises an embossed pattern being convergent with the tear path and/or the at least one fault line to enhance the sound generated by the tearing of the at least one fault line, and in that the embossed pattern comprises one or more regions of thinning, and wherein the gauge of the film in the region of thinning is at least about 2% lower than the rest of the film.

2. A film according to claim 1 wherein the gauge of the film in the region of thinning is at least about 5% lower than the rest of the film.

3. A film according to claim 1 wherein the gauge of the film in the region of thinning is at least about 10% lower than the rest of the film.

4. A film according to claim 1 wherein the region of thinning is created by means of ultrasonic vibration, laser etching, deformation or ablation, or heat treatment.

5. A film according to claim 1 wherein the embossed pattern is orientated generally in the direction of the tear path, as well as being convergent therewith.

6. A film according to claim 1 wherein the tear tab comprises a first end of a tear tape located on the inner surface of the film and extending along the length of the tear path adjacent to the at least one fault line.

7. A film according to claim 1 wherein the tear tab comprises a first end of a tear strip, said tear strip being defined by a first fault line and a second fault line.

8. A film according to claim 1 wherein the embossed pattern is mirrored along the at least one fault line and/or along the tear path.

9. A film according to claim 1 wherein the embossed pattern is a repetitive pattern along the length of the tear, path.

10. A film according to claim 1 wherein the embossed pattern is a herringbone pattern.

11. A film according to claim 1 wherein the tear path extends the entire length of the film.

12. A packaging for a container, comprising a flexible thermoplastic polymeric film comprising:

a tear path; and a tear tab extending from the outer surface of the film;

wherein the tear path comprises at least one fault line arranged to facilitate tearing of the film in one direction when the tear tab is pulled in a direction generally perpendicular to a side of a package;

characterized in that the at least one fault line comprises an embossed pattern being convergent with the tear path and/or the at least one fault line to enhance the sound generated by the tearing of the at least one fault line, and in that the embossed pattern comprises one or more regions of thinning, wherein the gauge of the film in the region of thinning is at least about 2% lower than the rest of the film.

13. The packaging of claim 12, wherein the gauge of the film in the region of thinning is at least about 10% lower than the rest of the film.

14. The packaging of claim 12, wherein the tear tab comprises a first end of a tear strip, said tear strip being defined by a first fault line and a second fault line.

15. A packaged container, comprising:

a container; and a flexible thermoplastic polymeric film, comprising:

a tear path; and a tear tab extending from the outer surface of the film;

wherein the tear path comprises at least one fault line arranged to facilitate tearing of the film in one direction when the tear tab is pulled in a direction generally perpendicular to the container;

wherein said at least one fault line comprises an embossed pattern being convergent with the tear path and/or the at least one fault line to enhance the sound generated by the tearing of the at least one fault line, and in that the embossed pattern comprises one or more regions of thinning, and wherein the gauge of the film in the region of thinning is at least about 2% lower than the rest of the film.

16. The packaging of claim 15, wherein the gauge of the film in the region of thinning is at least about 10% lower than the rest of the film.

17. A flexible thermoplastic polymeric film for enveloping a container comprising:

a tear path; and a tear tab extending from the outer surface of the film;

wherein the tear path comprises at least one fault line arranged to facilitate tearing of the film in one direction when the tear tab is pulled in a direction generally perpendicular to the container;

wherein said at least one fault line comprises an embossed pattern being convergent with the tear path and/or the at least one fault line to enhance the sound generated by the tearing of the at least one fault line, and in that the embossed pattern comprises one or more regions of thinning, and wherein the gauge of the film in the region of thinning is at least about 1% lower than the rest of the film.

18. A packaging for a container, comprising the flexible thermoplastic polymeric film of claim 17.

19. A packaged container, comprising a container and the flexible thermoplastic polymeric film of claim 17.

* * * * *